US006401443B2

(12) United States Patent
Scheufeld

(10) Patent No.: US 6,401,443 B2
(45) Date of Patent: Jun. 11, 2002

(54) YARN BRAKE AND A TWO-FOR-ONE TWISTING SPINDLE HAVING SUCH A YARN BRAKE

(75) Inventor: Heinz Scheufeld, Korschenbroich (DE)

(73) Assignee: Volkmann GmbH (DE)

( * ) Notice: Subject to any disclaimer, the term of this patent is extended or adjusted under 35 U.S.C. 154(b) by 0 days.

(21) Appl. No.: 09/895,282

(22) Filed: Jun. 29, 2001

(30) Foreign Application Priority Data

Jul. 1, 2000 (DE) ..... 100 32 141

(51) Int. Cl.[7] ..... D01H 1/10
(52) U.S. Cl. ..... 57/58.86
(58) Field of Search ..... 57/58.86, 58.49, 57/279, 58.83, 113; 242/152.1, 152, 147 R, 147 A

(56) References Cited

U.S. PATENT DOCUMENTS 3,975,893 A * 8/1976 Franzen ..... 57/279
4,281,508 A * 8/1981 Frebtsel-Beyme ..... 57/279
4,287,712 A * 9/1981 Franzen et al. ..... 57/279
4,391,090 A * 7/1983 Charbonnier ..... 57/279
4,468,920 A * 9/1984 Lorenz ..... 242/149
5,155,988 A * 10/1992 Nieratschker ..... 57/279
5,487,263 A 1/1996 Scheufeld et al.
5,581,988 A 12/1996 Fink et al.

FOREIGN PATENT DOCUMENTS

DE 3000443 * 7/1981
DE 3134763 * 6/1983
FR 1497288 * 10/1967

* cited by examiner

*Primary Examiner*—Danny Worrell
(74) *Attorney, Agent, or Firm*—R W Becker & Associates; R W Becker

(57) ABSTRACT

A two-for-one twisting machine is provided and includes a spindle having a yarn brake. The yarn brake includes a brake housing, a brake cartridge having opposed ends, first and second brake rings disposed within the brake housing, and a support element. The yarn brake also includes a guide conduit extending generally co-axially within the brake housing supporting the support element at a selectively variable axial location within the brake housing and a yarn intake tube extending within the guide conduit. A spring extends between the support element and the second brake ring for resiliently biasing the second brake ring and the brake cartridge is releasably compressively engaged by the first brake ring pressing against one end of the brake cartridge and the second brake ring pressing against the opposite end thereof.

7 Claims, 2 Drawing Sheets

YARN BRAKE AND A TWO-FOR-ONE TWISTING SPINDLE HAVING SUCH A YARN BRAKE

BACKGROUND OF THE INVENTION

The present invention relates to a yarn brake, especially, a yarn brake for a two-for-one twisting spindle or a two-for-one twisting spindle machine, having a substantially tube-shaped yarn brake housing in which a capsule-shaped brake cartridge is arranged, the brake cartridge comprising first and second telescopically movableable tube portions which are movableable against the bias of springs. Each tube portion of the brake cartridge has a substantially ball or curve shaped end portion with the pair of end portions disposed oppositely one another for each cooperating with a respective fixed axial position brake and/or a resiliently biased, axially movable brake ring with the pair of brake rings being at an adjustable axial spacing from one another.

Particularly in connection with the use of two-for-one twisting spindles, yarn brakes are known which comprise a yarn brake housing through which the yarn is axially trained. The inlet and outlet openings of the actual yarn brake region are respectively formed by brake rings having conical braking surfaces. The brake rings are typically comprised of a material having a high wear resistance. A brake cartridge, which forms the actual braking mechanism, extends between the individual inlet and outlet side of the brake rings and comprises two substantially cylindrical tube portions which are telescopically inserted into one another, and which include ball or curve shaped ends. The tubes enclose a spring which, upon the disposition of the brake cartridge in the yarn brake housing, outwardly resiliently biases the two tube end portions such that the curved-shaped ends of the tube portions are biased toward the brake rings and together therewith, as a function of the respective axial positions of the brake rings, exert the required braking force on the yarn traveling through the yarn brake. In accordance with the size of the required braking force, correspondingly stronger or weaker springs are disposed in the brake cartridge.

To permit adjustment or, respectively, setting of the braking force, it is known from DE 43 43 458 C2 (corresponding to U.S. Pat. No. 5,581,988) and DE 44 08 262 C2 (corresponding to U.S. Pat. No. 5,487,263), to set the axial position of the upper brake ring or, respectively, the brake ring carrier which supports this brake ring, in selected different settings so as to thereby vary the axial spacing of the upper and lower brake rings from one another. In the yarn brake disclosed in DE 43 43 458 C2, the lower brake ring is disposed in a fixed axial setting in the yarn brake housing while the upper brake ring is axially adjustably mounted in the yarn brake housing to thereby effect adjustment of the braking force. DE 44 08 262 C2 further discloses that the lower brake ring or, respectively, its brake ring carrier, can be adjusted relatively against the force of a return position spring by means of a downward pressure exerted from the direction of the upper brake ring, so that the downwardly moving brake cartridge, which is urged downwardly under the influence of gravity, can be supported against support elements which project radially inwardly from the inner wall of the yarn brake housing. The brake cartridge thereby loses contact with the upper and lower brake rings so that a training or feeding of the yarn through the yarn brake is possible.

It is an object of the present invention to provide simple and effective possibilities for altering the braking force.

SUMMARY OF THE INVENTION

By adjustment of the guide conduit and, thereby, the corresponding positions of the spring biased support element supported thereon, a gross or rough adjustment of the braking force can be realized while, through corresponding positioning of the brake ring disposed in the yarn intake tube, a fine adjustment of the braking force is possible, in that the yarn intake tube is axially adjustable relative to the guide conduit.

BRIEF DESCRIPTION OF THE DRAWINGS

The object and advantages of the present invention will appear more clearly from the following specification in conjunction with the accompanying schematic drawings, in which.

DETAILED DESCRIPTION OF THE PREFERRED EMBODIMENT

Figure 1:
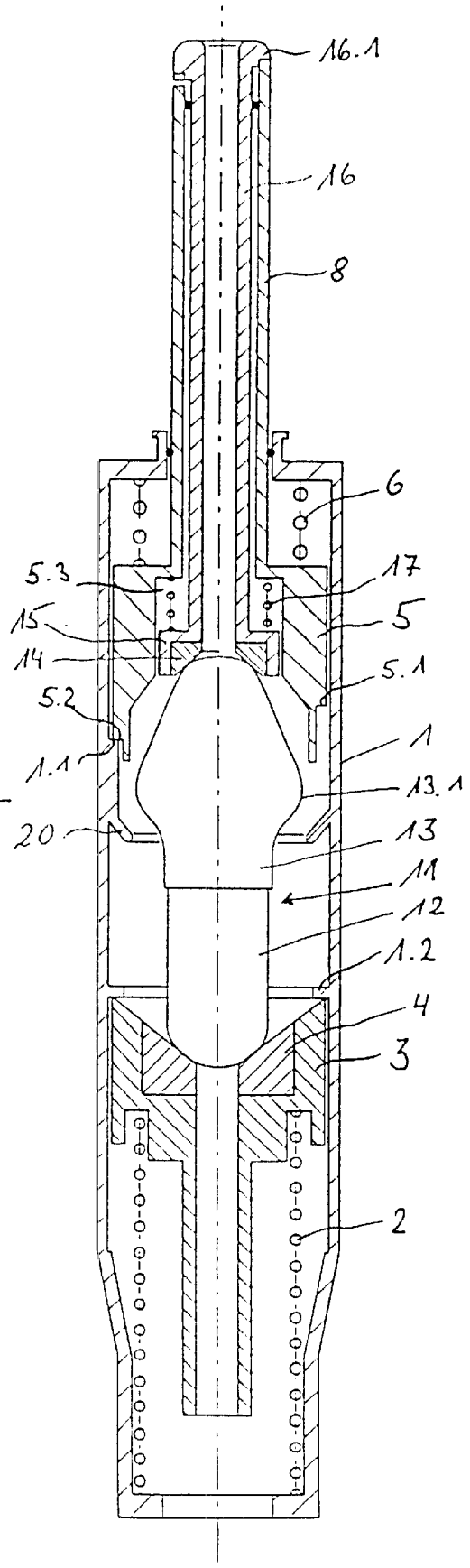
FIG. 1 is a sectional front elevational view of one embodiment of the yarn brake of the present invention for a two-for-one twisting spindle.

As shown in FIG. 1, the one embodiment of the yarn brake of the present invention includes a substantially cylindrical brake housing 1, in whose interior is disposed a piston-type configured brake ring 3 which is resiliently biased against an annular shoulder 1.2 by a spring 2 and which supports a yarn brake ring 4. A support element 5, which is cup-shaped, is mounted in the upper region of the brake housing 1 and is resiliently biased by a spring 6. The support element 5 is secured to the lower end of a guide conduit 8, which extends upwardly in the brake housing 1, and which includes an upper end communicated with the exterior of the brake housing. The cup-shaped support element 5 is divided around its outer circumference into a plurality of support shoulders 5.1, 5.2, whose surfaces are axially offset from one another. By rotation of the guide conduit 8, a respective one of the support shoulders, such as, for example, the support shoulder 5.1, can be brought into seated disposition against a radially inwardly extending projection 1.1 extending from the inner wall of the brake housing 1.

A yarn intake tube 16 is disposed in the guide conduit 8 and has, at its upper end, a flange portion 16.1 which extends in radially overlapping relationship over the upper end of the guide conduit 8 so as to thereby set the axial position of the yarn intake tube 16 within the guide conduit 8. A second yarn brake ring carrier 15 is disposed at the lower end of the yarn intake tube 16 and supports or carries thereon a second upper brake ring 14. The brake ring carrier 15 is disposed in the cylinder chamber 5.3 of the cup-shaped support element 5 so as to be axially displaceable relative thereto and is resiliently biased by a spring 17 extending therefrom against the bottom of the cylinder chamber 5.3.

Figure 2:
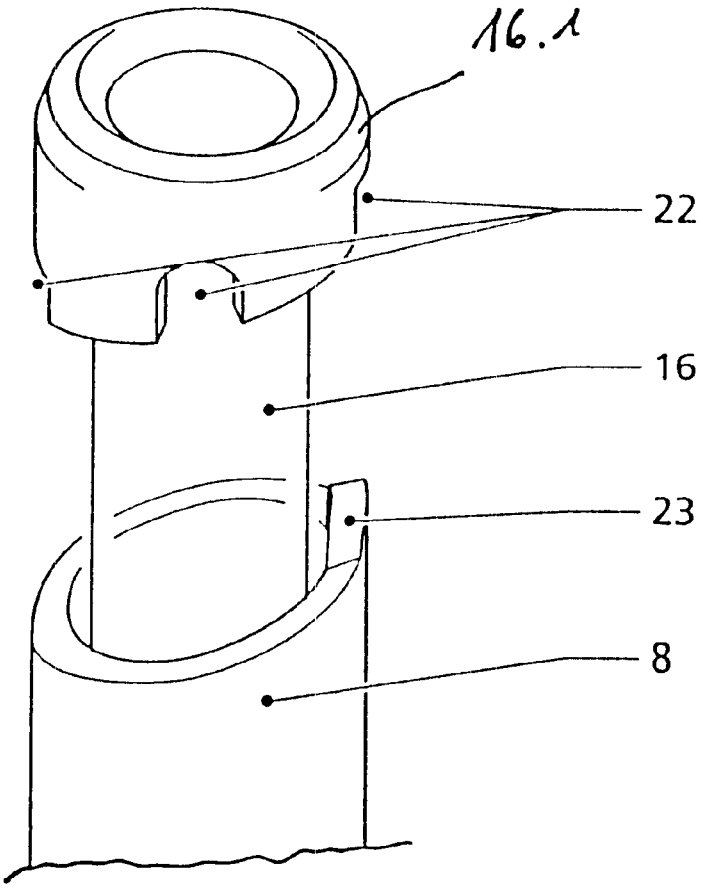
FIG. 2 is an enlarged perspective view of the yarn intake tube of a two-for-one twisting spindle.

As can be seen in FIG. 2, the upper edge of the guide conduit 8 is formed with an angled surface on which a projection 23, which is nose shaped, projects axially outwardly. The lower edge of the radially outwardly extending flange portion 16.1 of the yarn intake tube 16 is formed with an angled surface angled in correspondence with the upper edge of the guide conduit 8, and the circumference of the flange portion 16.1 is divided into a plurality of axially extending recesses or notches 22, each of which has a bottom which is at a respective different axial spacing from the top of the yarn intake tube 16.

One can adjust the relative axial position of the yarn brake carrier within the cup-shaped support element 5 by selective axial raising and turning of the yarn intake tube 16 so as to dispose a respective selected recess or notch 22 in seated engagement with the projection 23 formed on the top edge of the guide conduit 8.

A capsule shaped brake cartridge 11 is supported between the yarn brake rings 4 and 14, and is comprised of two telescopically relatively movable tube portions 12 and 13. The lower tube portion 12 is substantially in the form of a cylindrical tube and includes a lower curved or arcuate end portion. The upper tube portion 13 is, as well, configured as a cylindrical tube and includes, in its middle or central portion, an outwardly flared portion 13.1 and, at its upper end, includes a ball or curve shaped end portion.

In connection with the brake cartridge, the brake cartridge includes a conventional construction element in the form of a spring disposed interiorly thereof whose resilient biasing force can be opposed so as to move the two tube portions 12 and 13 toward one another.

To produce the braking force in connection with the yarn brake of the present invention, springs within the brake cartridge 11, on the one hand, and springs for respective positioning or, respectively, axial movement, of the two brake rings 4, 14 are provided. By corresponding positioning of the cup-shaped support element 5, a gross or rough adjustment of the braking force can be adjustably set while, through corresponding positioning of the upper brake ring 14, a fine adjustment of the braking force is possible, in that the yarn intake tube 16 can be adjustably axially positioned within the guide conduit 8.

If, for the purpose of training a yarn through the yarn brake, the lower brake ring 3 is biased against the force of the spring 2 in a conventional manner such as, for example, in a pneumatic manner, the lower brake ring 3 is displaced downwardly such that the brake cartridge 11 can move relatively within the brake housing 1 and a plurality of radially inwardly extending support elements 20 support or, respectively, catch the brake cartridge 11, in that these support elements 20 engage the radially outwardly extending portion 13.1 of the brake cartridge.

The specification incorporates by reference the disclosure of German priority document 100 32 141.0-26 filed Jul. 1, 2000.

The present invention is, of course, in no way restricted to the specific disclosure of the specification and drawings, but also encompasses any modifications within the scope of the appended claims.

What I claim is:

1. A yarn brake comprising:

a generally elongate brake housing having a longitudinal axis;

a brake cartridge having opposed ends each of which has a curved shape;

a first brake ring disposed within the brake housing, the first brake ring being resiliently biased in one axial direction;

a second brake ring disposed within the brake housing and being a selected one of a fixed axial distance from the first brake ring and a variable axial distance from the first brake ring;

a support element, the support element being resiliently biased in an opposite axial direction opposite to the one axial direction;

a guide conduit extending generally co-axially within the brake housing and having an outlet end opening to the exterior at one axial end of the brake housing, the guide conduit supporting the support element at a selectively variable axial location within the brake housing;

a yarn intake tube extending within the guide conduit such that one axial end of the yarn intake tube is disposed in the interior of the brake housing, and the yarn intake tube being axially movably positionable relative to the guide conduit between at least two different axial positions, the second brake ring being supported by the yarn intake tube generally at the one axial end thereof; and means extending between the support element and the second brake ring for resiliently biasing the second brake ring in the opposite axial direction; the brake cartridge being releasably compressively engaged by the first brake ring pressing against one end of the brake cartridge and the second brake ring pressing against the opposite end thereof.

2. A yarn brake according to claim 1, wherein the outlet end of the guide conduit is formed with an angled surface having a projection projecting axially outwardly and the yarn intake tube has an outlet end having a flange surface extending in radially overlapping relationship over the outlet end of the guide conduit, the flange surface of the yarn intake tube being angled in correspondence with the angled surface of the outlet end of the guide conduit and having at least two seating notches each configured for receiving the projection of the guide conduit therein such that the projection contacts the bottom of the seating notch and the bottom of each seating notch being at a respective different axial spacing from the top of the yarn intake tube such that the axial position of the yarn intake tube within the guide conduit can be selectively varied by seating of the projection of the guide conduit in a respective one of the seating notches of the yarn intake tube.

3. A yarn brake according to claim 1, wherein the brake housing includes a radially inwardly extending projection and the support element includes at least two shoulder portions at one end thereof and each at an axial offset from the other shoulder portions and each shoulder portion being selectively disposable into engagement with the radially inwardly extending projection of the brake housing to thereby vary the axial position of the support element relative to the brake housing.

4. A yarn brake according to claim 1, wherein the support element is cup-shaped and includes a cylinder chamber within which extends a spring which resiliently biases the brake ring.

5. A yarn brake according to claim 1, wherein the brake ring is disposed in a brake ring carrier, which is disposed in a piston-type manner in the yarn brake housing, and which is selectively movable against the force of a return position spring to effect release of the yarn cartridge, and further comprising support elements extending radially inwardly from the inner wall of the yarn brake housing for supporting the brake cartridge in the middle region thereof in which a radially outwardly extending flange portion is formed.

6. A spindle for the winding of a yarn thereon, comprising:

a yarn brake including:

a generally elongate brake housing having a longitudinal axis;

a brake cartridge having opposed ends each of which has a curved shape;

a first brake ring disposed within the brake housing, the first brake ring being resiliently biased in one axial direction;

a second brake ring disposed within the brake housing and being a selected one of a fixed axial distance from the first brake ring and a variable axial distance from the first brake ring;

a support element, the support element being resiliently biased in an opposite axial direction opposite to the one axial direction;

a guide conduit extending generally co-axially within the brake housing and having an outlet end opening to the exterior at one axial end of the brake housing, the guide conduit supporting the support element at a selectively variable axial location within the brake housing;

a yarn intake tube extending within the guide conduit such that one axial end of the yarn intake tube is disposed in the interior of the brake housing, and the yarn intake tube being axially movably positionable relative to the guide conduit between at least two different axial positions, the second brake ring being supported by the yarn intake tube generally at the one axial end thereof; and means extending between the support element and the second brake ring for resiliently biasing the second brake ring in the opposite axial direction; the brake cartridge being releasably compressively engaged by the first brake ring pressing against one end of the brake cartridge and the second brake ring pressing against the opposite end thereof.

7. A two-for-one twisting machine comprising:

a yarn brake including:

a generally elongate brake housing having a longitudinal axis;

a brake cartridge having opposed ends each of which has a curved shape;

a first brake ring disposed within the brake housing, the first brake ring being resiliently biased in one axial direction;

a second brake ring disposed within the brake housing and being a selected one of a fixed axial distance from the first brake ring and a variable axial distance from the first brake ring;

a support element, the support element being resiliently biased in an opposite axial direction opposite to the one axial direction;

a guide conduit extending generally co-axially within the brake housing and having an outlet end opening to the exterior at one axial end of the brake housing, the guide conduit supporting the support element at a selectively variable axial location within the brake housing;

a yarn intake tube extending within the guide conduit such that one axial end of the yarn intake tube is disposed in the interior of the brake housing, and the yarn intake tube being axially movably positionable relative to the guide conduit between at least two different axial positions, the second brake ring being supported by the yarn intake tube generally at the one axial end thereof; and means extending between the support element and the second brake ring for resiliently biasing the second brake ring in the opposite axial direction; the brake cartridge being releasably compressively engaged by the first brake ring pressing against one end of the brake cartridge and the second brake ring pressing against the opposite end thereof.

* * * * *